US006269673B1

(12) United States Patent
Wang

(10) Patent No.: US 6,269,673 B1
(45) Date of Patent: Aug. 7, 2001

(54) RECIPROCATING MECHANISM FOR A FORGING MACHINE

(75) Inventor: Sheng-Yau Wang, Tainan Hsien (TW)

(73) Assignee: San Shing Hardware Works Co., Ltd., Tainan Hsien (TW)

( * ) Notice: Subject to any disclaimer, the term of this patent is extended or adjusted under 35 U.S.C. 154(b) by 0 days.

(21) Appl. No.: 09/531,074

(22) Filed: Mar. 18, 2000

(51) Int. Cl.[7] ..... B21D 43/05

(52) U.S. Cl. ..... 72/405.11; 72/405.01; 470/95; 470/109; 470/154; 74/110

(58) Field of Search ..... 74/110; 470/95, 470/109, 154; 72/405.16, 405.13, 405.11, 405.01

(56) References Cited

U.S. PATENT DOCUMENTS

| | | | | |
|---|---|---|---|---|
| 966,046 | * | 8/1910 | Noonan | 74/110 |
| 3,077,259 | * | 2/1963 | Braun | 74/110 |
| 3,120,970 | * | 2/1964 | Tucker | 74/110 |
| 3,421,637 | * | 1/1969 | Sofy | 74/110 |
| 3,655,070 | * | 4/1972 | Haydu | 214/1 BB |
| 3,999,495 | * | 12/1976 | Rouse | 72/405.13 |
| 4,402,677 | * | 9/1983 | Radocaj | 74/110 |
| 4,524,630 | * | 6/1985 | Toth | 74/110 |

* cited by examiner

*Primary Examiner*—Daniel C. Crane
(74) *Attorney, Agent, or Firm*—Christie, Parker & Hale, LLP

(57) ABSTRACT

A reciprocating mechanism includes a seat body, a longitudinal first slide member, and a second slide member. The seat body has therein a longitudinal first guiding groove, a second guiding groove intersecting the first guiding groove, and a crossing space at the intersection of the first and second guiding grooves. The first slide member is disposed slidably and reciprocatingly in the first guiding groove across the crossing space, and has a longitudinal cam member extending longitudinally of the first slide member. The second slide member is mounted slidably on the seat body along the direction of the second guiding groove, and incorporates a cam follower which extends into the crossing space to contact the cam member. The cam follower is movable to-and-fro along the second guiding groove when the cam member reciprocates along the first guiding groove, thereby moving reciprocatingly the second slide member along the second guiding groove.

3 Claims, 9 Drawing Sheets

RECIPROCATING MECHANISM FOR A FORGING MACHINE

BACKGROUND OF THE INVENTION

1. Field of the Invention

This invention relates to a reciprocating mechanism for a forging machine, more particularly to a reciprocating mechanism that transfers a driving force without vibrating a swing mechanism of the forging machine.

2. Description of the Related Art

Referring to FIG. 1, a conventional forging machine 1 is shown to comprise a machine frame 11, a plurality of female dies 12 mounted on the machine frame 11, a support member 13 mounted on the machine frame 11 above the female dies, and a swing mechanism 15 connected movably to the support member 13. The swing mechanism 15 includes a swing plate 14 and a plurality of workpiece holding members 151 connected operatively to the swing plate 14. The swing plate 14 is connected to a conventional reciprocating mechanism in order to reciprocate in a left-and-right direction in FIG. 1 via a horizontal linkage mechanism 18. During the reciprocal movement of the swing plate 14, the workpiece holding members 151 hold and transfer in sequence blanks to the female dies for carrying out subsequent punching processes.

Referring to FIG. 2, the conventional reciprocating mechanism includes an inverted Y-shaped rocker arm 17 having an upper end connected pivotally to the horizontal linkage mechanism 18, and two separate lower ends 172 that engage alternately a cam member 16 when the cam member 16 is driven to rotate. The rocker arm 17 swings to reciprocate the swing plate 14 via the horizontal linkage mechanism 18.

The disadvantage of the conventional reciprocating mechanism resides in that, because the torque applied to the horizontal linkage mechanism 18 is opposed to the inertia of the horizontal linkage mechanism 18 and the swing plate 16 at two dead points of each stroke of the rocker arm 17, the upper end 171 of the rocker arm 17 is liable to flex and vibrate at the dead ends. The vibrations of the rocker arm 17 will transfer to the swing plate 14 via the horizontal linkage mechanism 18, thereby resulting in shaking or wobbling of the swing plate 14. The shaking or wobbling of the swing plate 14 adversely affects the subsequent punching processes.

SUMMARY OF THE INVENTION

The object of the present invention is to provide a reciprocating mechanism that transfers a driving force without vibrating a swing mechanism of a forging machine.

According to the present invention, a reciprocating mechanism includes a seat body, a longitudinal first slide member, and a second slide member. The seat body has therein a longitudinal first guiding groove, a second guiding groove intersecting the first guiding groove, and a crossing space at the intersection of the first and second guiding grooves. The first slide member is disposed slidably and reciprocatingly in the first guiding groove across the crossing space, and has a longitudinal cam member extending longitudinally of the first slide member. The second slide member is mounted slidably on the seat body along the direction of the second guiding groove, and incorporates a cam follower which extends into the crossing space to contact the cam member. The cam follower is movable to-and-fro along the second guiding groove when the cam member reciprocates along the first guiding groove, thereby moving reciprocatingly the second slide member along the second guiding groove.

In a preferred embodiment, the first slide member includes a plate member having two opposite substantially straight longitudinal sides extending along the direction of the first guiding groove, two opposite transverse ends transverse to the longitudinal sides, and a cam support face between the longitudinal sides. The cam member projects from the cam support face in the form of a bent ridge which has a first section that extends longitudinally adjacent to one of the longitudinal sides and one of the transverse ends, a second section that extends longitudinally adjacent to another one of the longitudinal sides and another one of the transverse ends, and a third section that is curved and that inclines gradually from the first section to the second section. The cam follower includes a contact roller which is mounted on the second slide member and which extends into the crossing space adjacent to the cam member. The contact roller has a rolling face in contact with the cam member.

Preferably, the seat body includes a longitudinal first guiding seat and a transverse second guiding seat. The first guiding seat has an intermediate part formed with a positioning groove extending transversely of the first guiding seat to position the second guiding seat. The first guiding groove extends longitudinally of the first guiding seat and passes through the second guiding seat. The second guiding groove is formed in the second guiding seat and passes through the first guiding groove. The second slide member is mounted slidably inside the second guiding groove. The first slide member is slidably mounted inside the first guiding groove below the second slide member.

Preferably, the cam follower further includes a thrust roller which is mounted on the second slide member and which is in rolling contact with one side of the cam member opposite to the contact roller. The contact roller is biased to press the cam member against the thrust roller. The second slide member further includes a first shaft mounted rotatably thereon. The first shaft has a first part extending into the contact roller, and a second part extending outwardly of the contact roller. The first part is eccentric to the second part so as to place the contact roller in a position eccentric to the second part. The second slide member further includes a push rod which has one end connected to the second part of the first shaft and which has an opposite end extending radially outward away from the first shaft. A biasing unit is mounted on the second slide member to bias the opposite end of the push rod so that the first shaft is turned in one direction and moves eccentrically the contact roller toward the cam member.

The biasing unit includes a stationary support mounted on the second slide member, a cantilever arm which extends from the stationary support to the push rod and which passes through the opposite end of the push rod, and a coiled spring sleeved onto the cantilever arm to urge the push rod. The second slide member includes a bottom side adjacent to the first slide member, a top side opposite to the bottom side, and two through holes extending from the top side to the bottom side. The contact and thrust rollers are disposed adjacent to the bottom side. The first shaft extends through one of the through holes. The thrust roller has a second shaft extending through another one of the through holes. The biasing unit is disposed at the top side.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
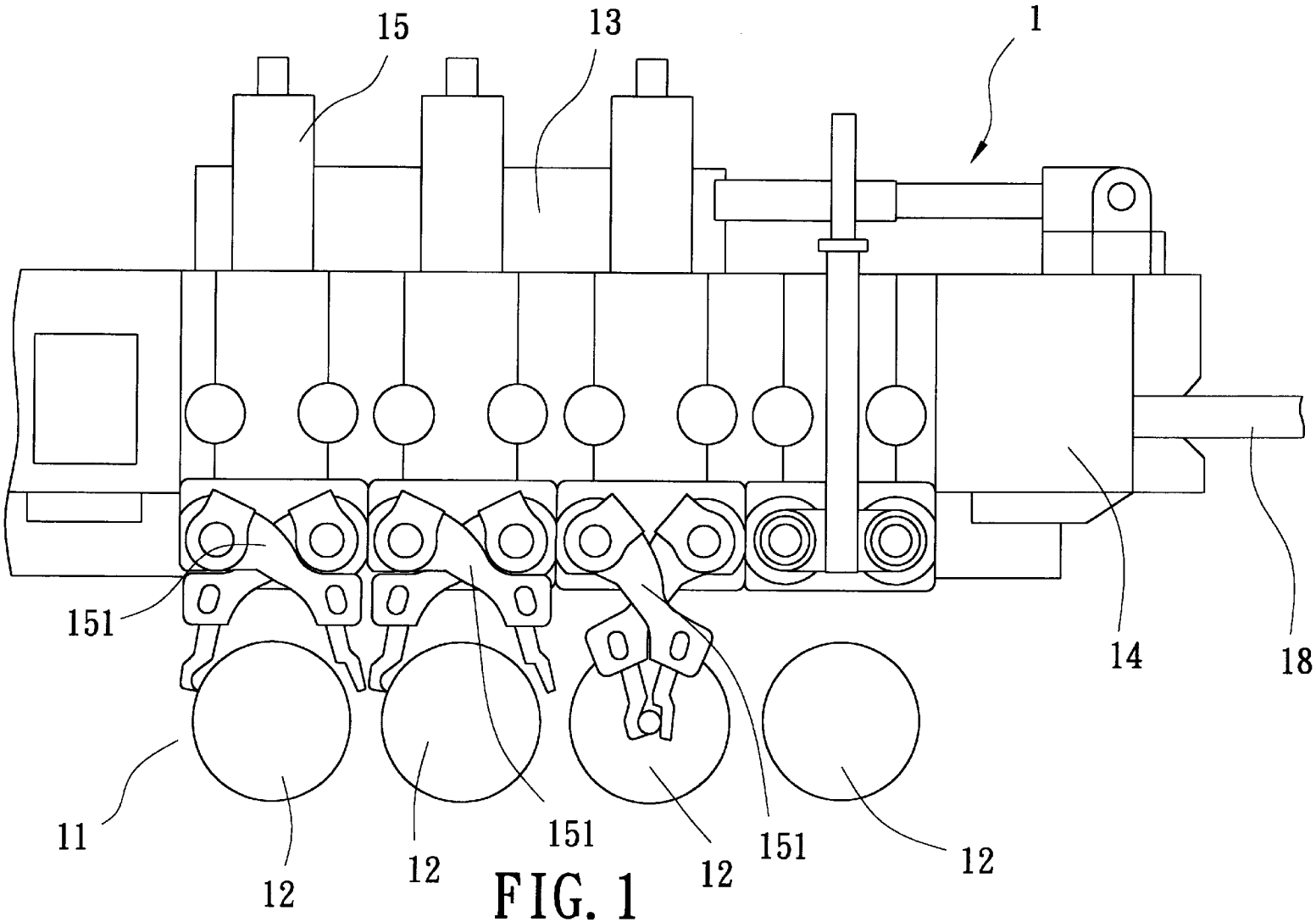
FIG. 1 PRIOR ART
FIG. 1 is a schematic front view of a part of a conventional forging machine.
Figure 2:
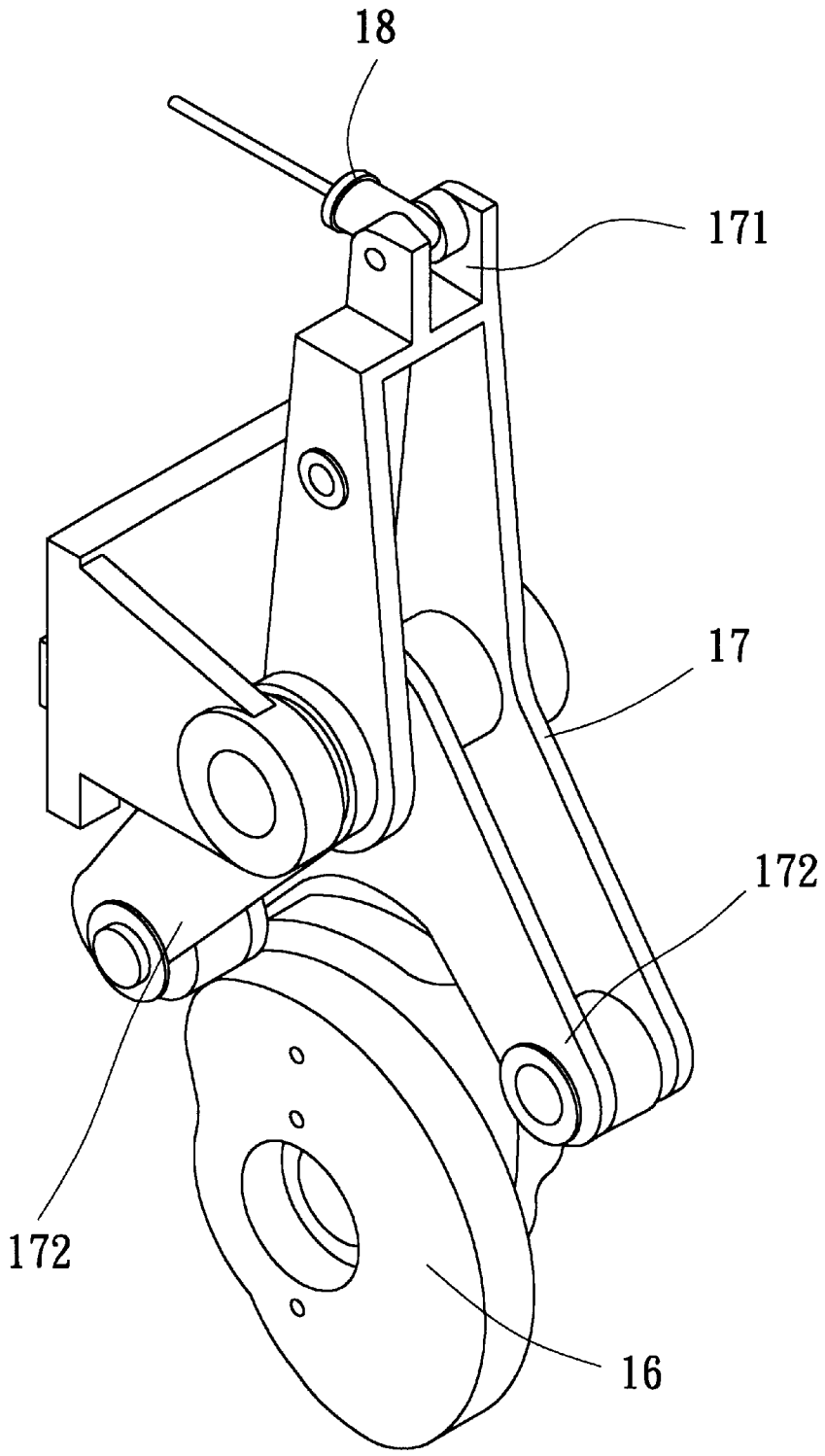
FIG. 2 PRIOR ART
FIG. 2 is a perspective schematic view of a conventional reciprocating mechanism that is used with the conventional forging machine of FIG. 1.
Figure 3:
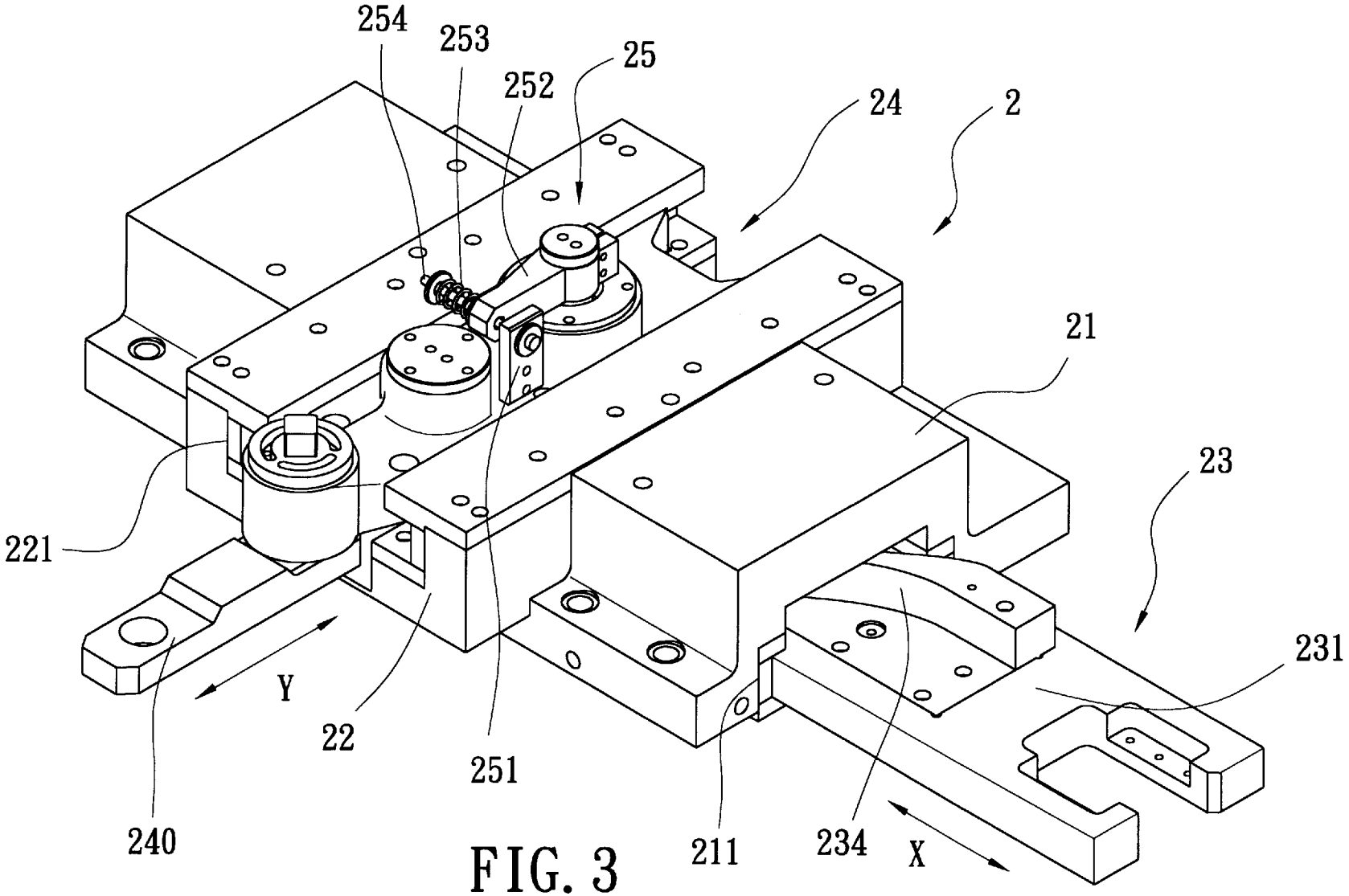
FIG. 3 is a perspective view of a preferred embodiment of a reciprocating mechanism for a forging machine according to the present invention.
Figure 4:
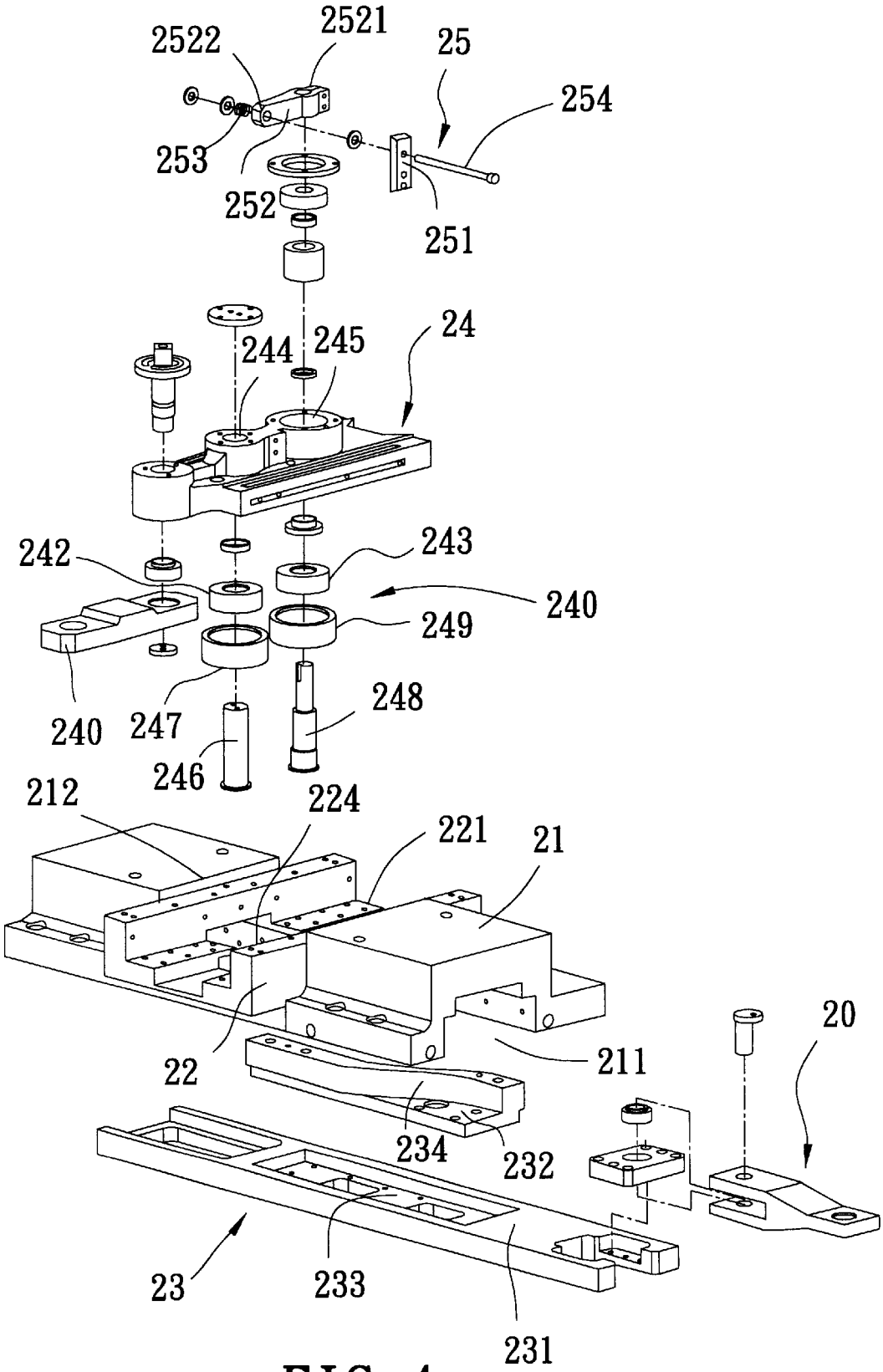
FIG. 4 is a perspective exploded view of the preferred embodiment of the reciprocating mechanism according to the present invention.

Referring to FIGS. 3 and 4, a preferred embodiment of a reciprocating mechanism according to the present invention is shown to include a seat body 2, a longitudinal first slide member 23, and a second slide member 24.

Figure 5:
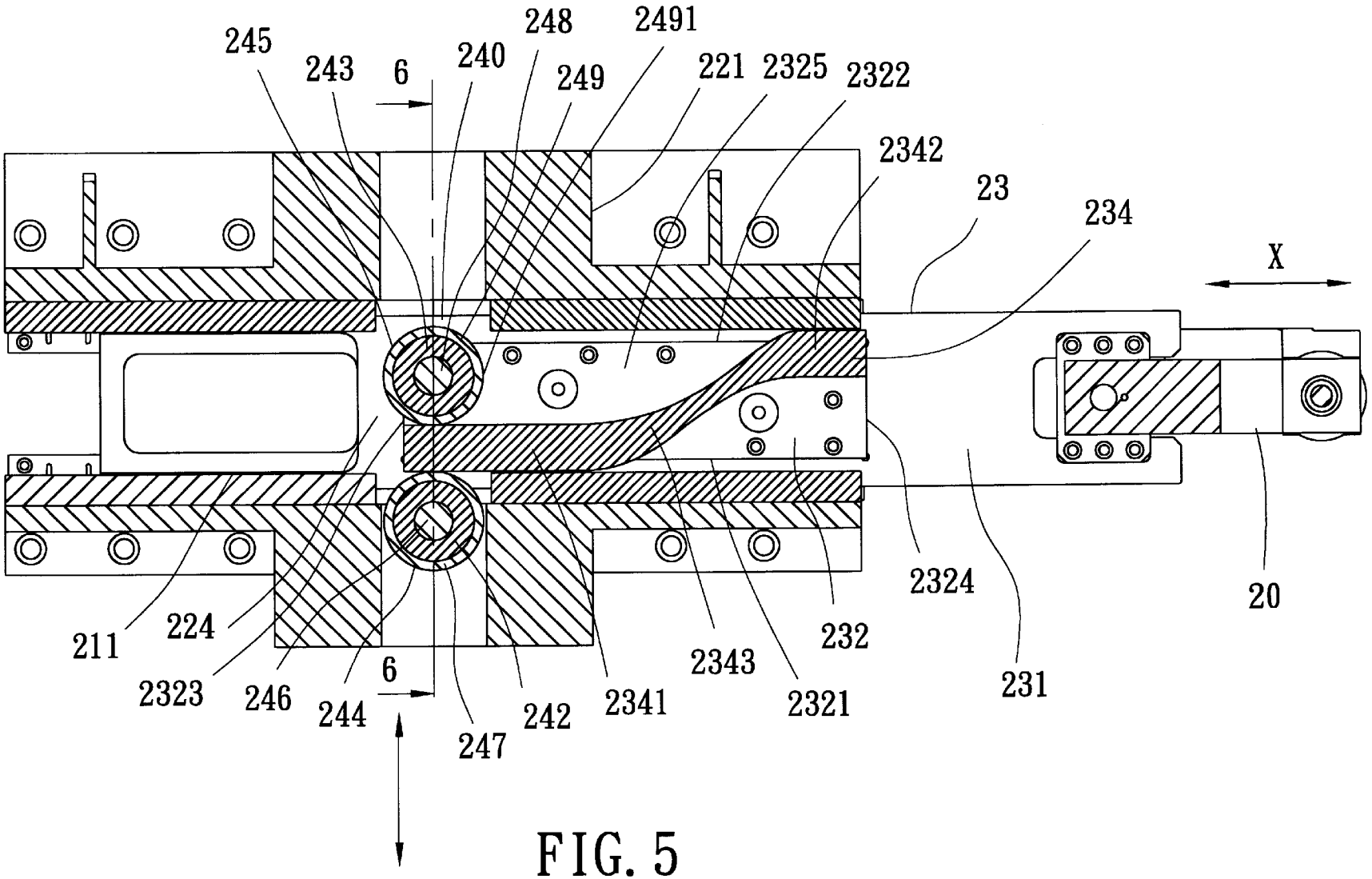
FIG. 5 is a cross sectional view of the preferred embodiment of the reciprocating mechanism according to the present invention.

As shown, the seat body 2 includes a longitudinal first guiding seat 21 and a transverse second guiding seat 22. The first guiding seat 21 has an intermediate part formed with a positioning groove 212 extending transversely of the first guiding seat 21 to position the second guiding seat 22. A first guiding groove 211 of a T-shaped cross-section extends longitudinally of the first guiding seat 21 and passes through the second guiding seat 22. A second guiding groove 221 of an inverted T-shaped cross-section is formed in a top side of the second guiding seat 22 and passes through the first guiding groove 211. The first and second guiding grooves 211, 221 intersect with one another to form a crossing space 224 at the intersection of the first and second guiding grooves 211, 221. The first slide member 23 is disposed slidably and reciprocatingly in the first guiding groove 211 across the crossing space 224 along a direction as indicated by an arrow "X" in FIG. 3. The second slide member 24 is mounted slidably in the second guiding groove 221 along a direction of the second guiding groove 221 as indicated by an arrow "Y" in FIGS. 3 and 9. The first slide member 23 reciprocates below the second slide member 22, and has a longitudinal cam member 234 extending longitudinally of the first slide member 23. The second slide member 24 incorporates a cam follower 240 which extends into the crossing space 224 to contact the cam member 234, as best illustrated in FIG. 5, which will be described in greater detail hereinbelow. The cam follower 240 is movable to-and-fro along the second guiding groove 221 when the cam member 234 reciprocates along the first guiding groove 211, thereby moving reciprocatingly the second slide member 24 along the second guiding groove 221.

Figure 6:
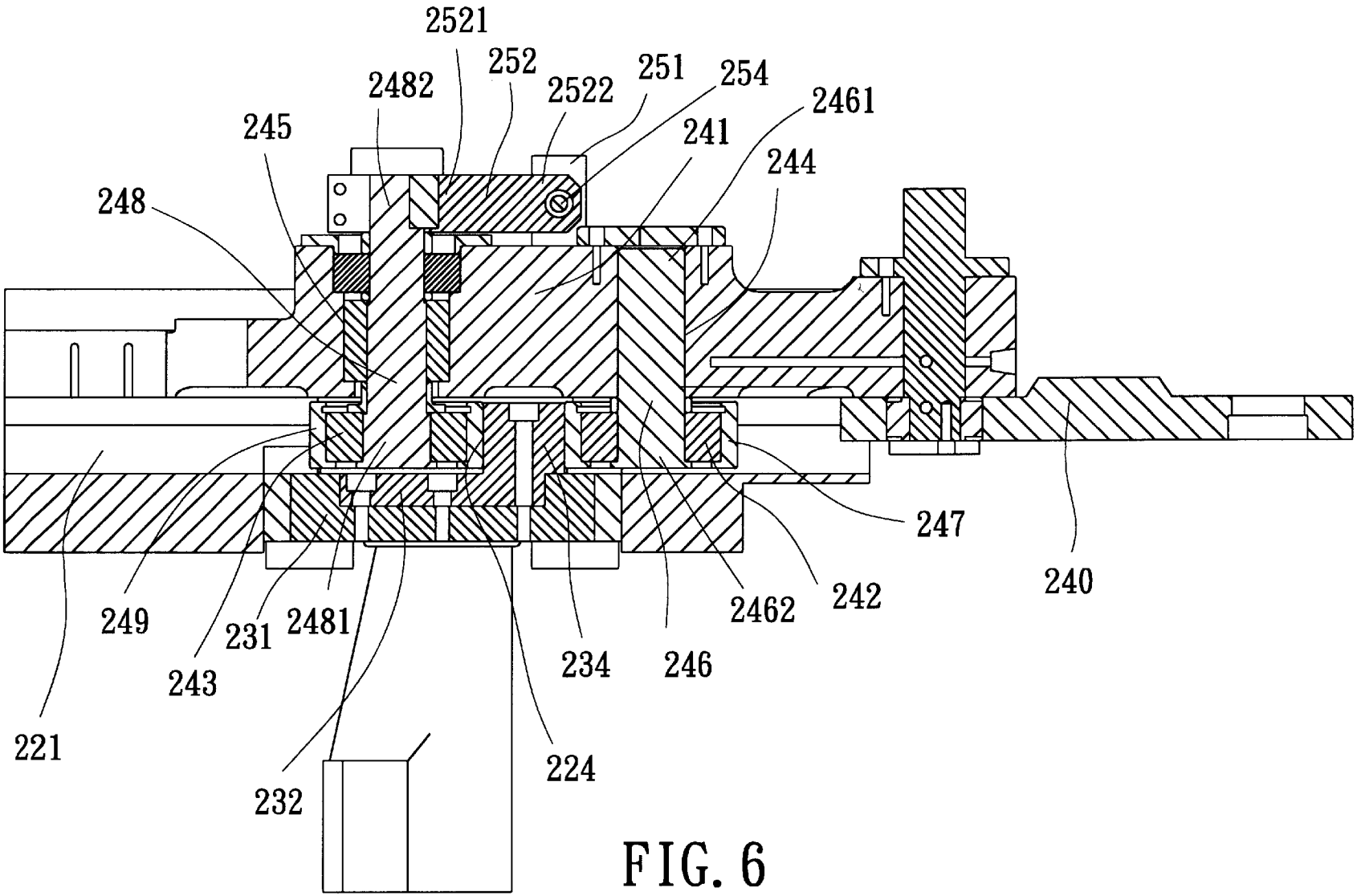
FIG. 6 is a sectional view taken generally along the line 6—6 of FIG. 5.

Referring to FIGS. 4, 5 and 6, the first slide member 23 further includes an elongated body portion 231 and a plate member 232 fixed in a cavity 233 formed in the body portion 231. The body portion 231 has a connecting member 20 that is connected to an outer end thereof and that may be in turn connected to a cam mechanism (not shown). The plate member 232 has two opposite substantially straight longitudinal sides 2321, 2322 extending along the direction "X" of the first guiding groove 211, two opposite transverse ends 2323, 2324 transverse to the longitudinal sides 2321, 2322, and a cam support face 2325 between the longitudinal sides 2321, 2322. The cam member 234 projects from the cam support face 2325 in the form of a bent ridge which has a first section 2341 that extends longitudinally adjacent to one of the longitudinal sides 2321 and one of the transverse end 2323, a second section 2342 that extends longitudinally adjacent to another one of the longitudinal sides 2322 and another one of the transverse ends 2324, and a third section 2343 that is curved and that inclines gradually from the first section 2341 to the second section 2342.

The cam follower 240 includes a contact roller 249 and a thrust roller 247 which are mounted respectively on a bottom side of the second slide member 24 adjacent to the first slide member 23 and which extend into the crossing space 224 adjacent to the cam member 234. The contact roller 249 has a rolling face 2491 in contact with one side of the cam member 234. The thrust roller 247 is in rolling contact with the other side of the cam member 234 opposite to the contact roller 249. The contact roller 249 is biased to press the cam member 234 against the thrust roller 247.

Figure 7:
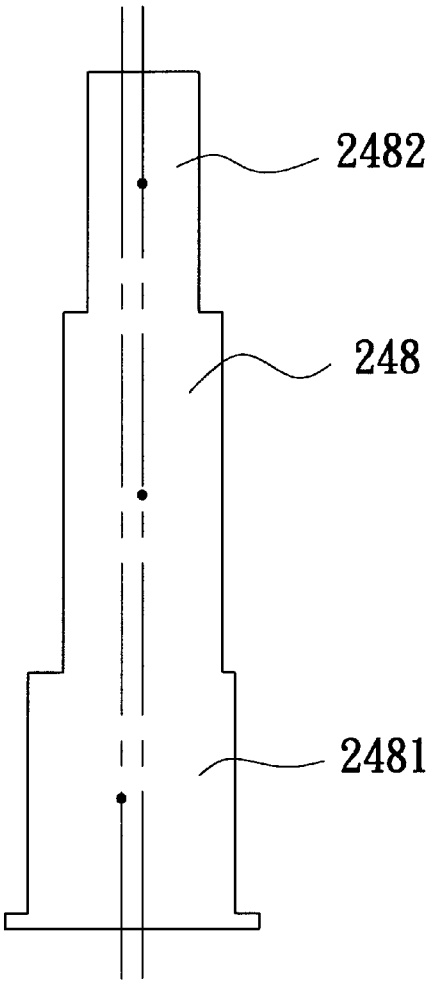
FIG. 7 is an exaggerated schematic view of a shaft of the preferred embodiment of the reciprocating mechanism according to the present invention.

The second slide member 24 further includes a first shaft 248 mounted rotatably thereon. The first shaft 248 has a first part 2481 extending into the contact roller 249, and a second part 2482 extending outwardly of the contact roller 249, as best illustrated in FIG. 6. The first part 2481 is eccentric to the second part 2482 so as to place the contact roller 249 in a position eccentric to the second part 2482, as best illustrated in FIG. 7. The second slide member 24 further includes a push rod 252 which has one end 2521 connected to the second part 2482 of the first shaft 248 and which has an opposite end 2522 extending radially outwardly away from the first shaft 248. A linking plate 240 is connected to an outer end of the second slide member 24.

Figure 8:
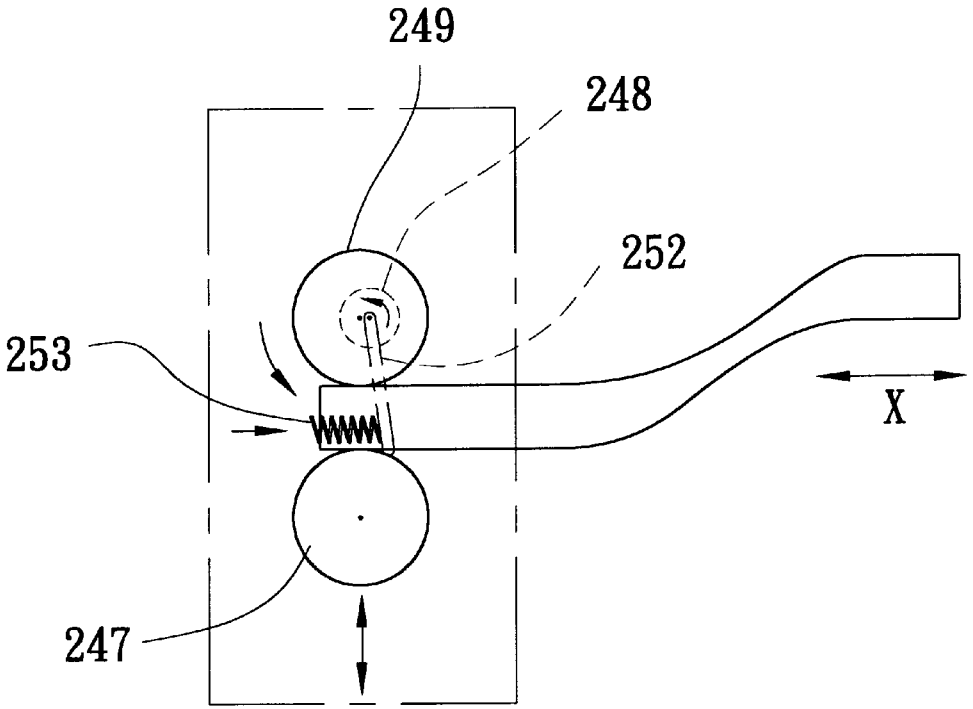
FIG. 8 is an exaggerated schematic view illustrating how the shaft of FIG. 7 is operated in the preferred embodiment of the reciprocating mechanism according to the present invention.

A biasing unit 25 is mounted on the second slide member 24 to bias the opposite end 2522 of the push rod 252 so that the first shaft 248 is turned in one direction and moves eccentrically the contact roller 249 toward the cam member 234, as best illustrated in FIG. 8. The biasing unit 25 includes a stationary support 251 mounted on the top side of the second slide member 24, a cantilever arm 254 which extends from the stationary support 251 to the push rod 252 and which passes through the opposite end 2522 of the push rod 252, and a coiled spring 253 sleeved onto the cantilever arm 254 to urge the push rod 252 to turn the first shaft 248 in order to move the contact roller 249 toward the cam member 234 as described hereinbefore. In this way, even though the contact roller 249 is worn out after being in use for a period of time, the contact roller 249 can abut constantly against the cam member 234 during the reciprocating movement of the cam member 234 along the direction "X" to ensure positive engagement among the contact and thrust rollers 249, 247 and the cam member 234. The second slide member 24 has two through holes 245, 244 extending from the top side to the bottom side thereof. The first shaft 248 extends through one of the through holes 245. The thrust roller 247 has a second shaft 246 extending through another one of the through holes 244. The second shaft 246 has an upper end 2461 fixed to the top side of the second slide member 24, and a lower end 2462 connected rotatably to the thrust roller 247 via a bearing member 242. The contact roller 249 is connected rotatably to the first shaft 248 via a bearing member 243.

Figure 9:
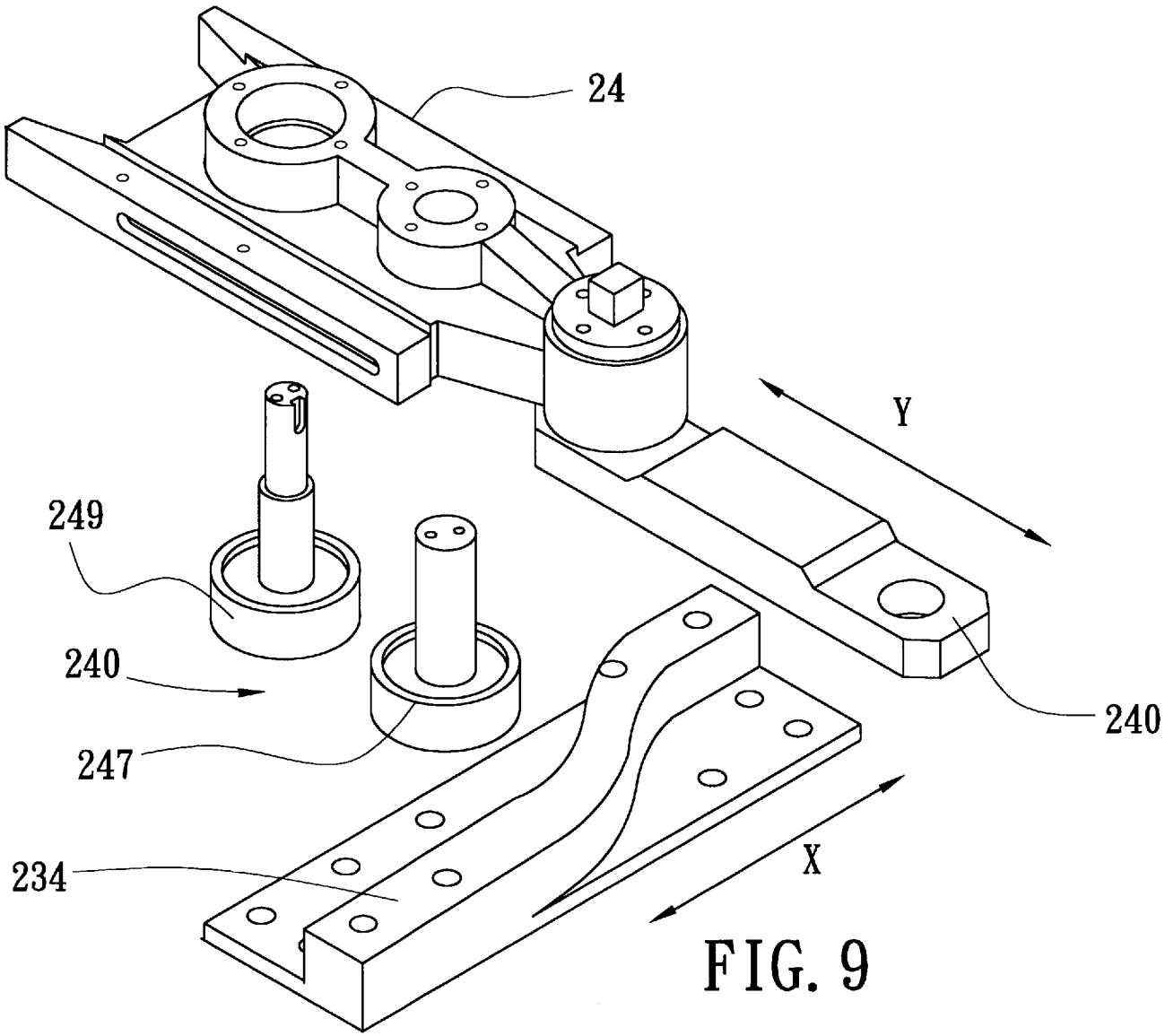
FIG. 9 is a perspective exploded view of first and second slide members of the preferred embodiment of the reciprocating mechanism according to the present invention.
Figure 10:
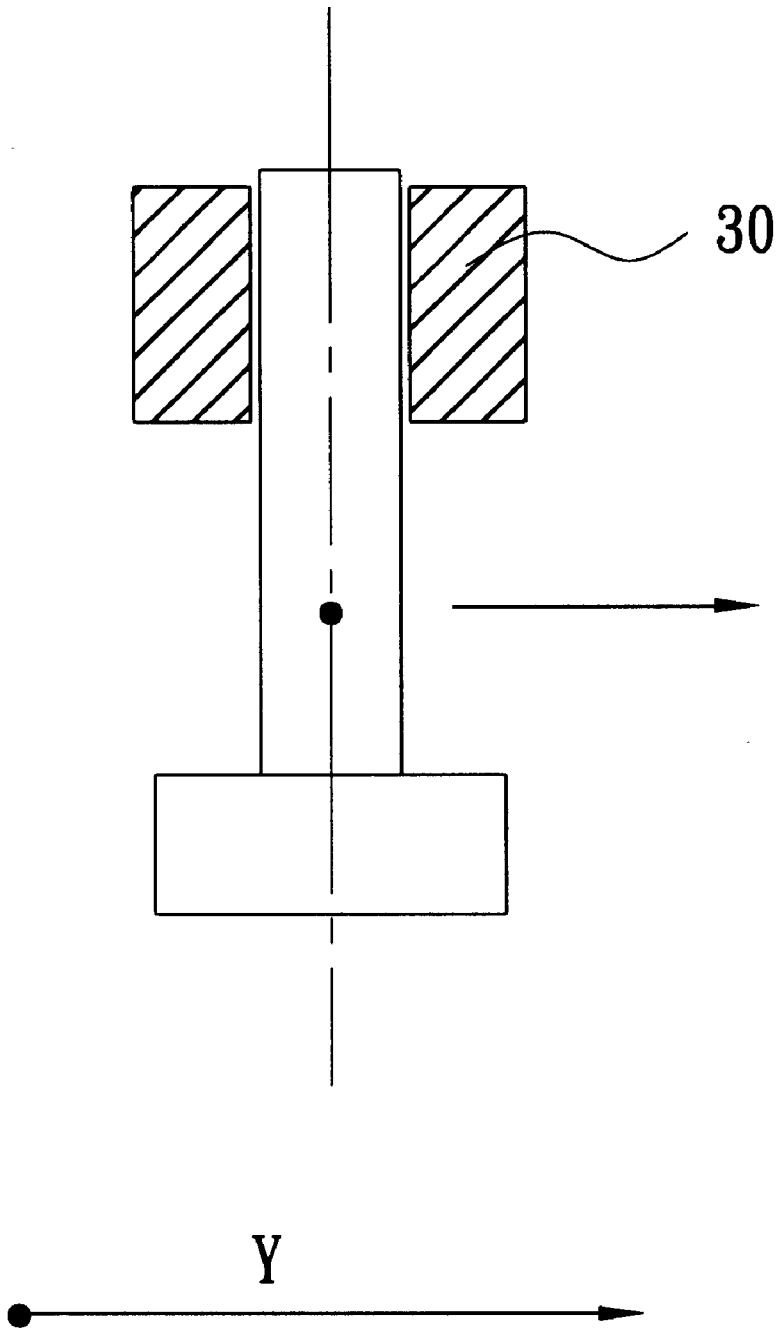
FIG. 10 is a schematic view illustrating how a workpiece holding member on a swing plate of the forging machine is moved by the preferred embodiment of the reciprocating mechanism according to the present invention.

Referring to FIG. 9, when a driving force is exerted by a cam mechanism (not shown) to the first slide member 23 via the connecting member 20 in order to reciprocate the first slide member 23 in the direction "X", the second slide member 24 can reciprocate in the direction "Y" to drive a swing plate 30 of a forging machine via the linking plate 240, as best illustrated in FIG. 10. It is noted that the force transmission directions "X" and "Y" in the reciprocating mechanism of the present invention are perpendicular to one another on a horizontal plane. As such, a vibration transferred to the first slide member 23 along the direction "X" will not be transferred to the second slide member 24, thereby preventing shaking or wobbling of the swing plate 30. The object of the present invention is thus met.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A reciprocating mechanism, comprising:

a seat body including therein a longitudinal first guiding groove, a second guiding groove intersecting said first guiding groove, and a crossing space at the intersection of said first and second guiding grooves;

a longitudinal first slide member disposed slidably and reciprocatingly in said first guiding groove across said crossing space and having a longitudinal cam member extending longitudinally of said first slide member; and a second slide member mounted slidably on said seat body along the direction of said second guiding groove and incorporating a cam follower which extends into said crossing space to contact said cam member, said cam follower being movable to-and-fro along said second guiding groove when said cam member reciprocates along said first guiding groove, thereby moving reciprocatingly said second slide member along said second guiding groove, wherein said first slide member includes a plate member having two opposite substantially straight longitudinal sides extending along the direction of said first guiding groove, two opposite transverse ends transverse to said longitudinal sides, and a cam support face between said longitudinal sides, said cam member projecting from said cam support face in the form of a bent ridge which has a first section that extends longitudinally adjacent to one of said longitudinal sides and one of said transverse ends, a second section that extends longitudinally adjacent to another one of said longitudinal sides and another one of said transverse ends, and a third section that is curved and that inclines gradually from said first section to said second section, said cam follower including a contact roller which is mounted on said second slide member and which extends into said crossing space adjacent to said cam member, said contact roller having a rolling face in contact with said cam member, wherein said cam follower further includes a thrust roller which is mounted on said second slide member and which is in rolling contact with one side of said cam member opposite to said contact roller, said contact roller being biased to press said cam member against said thrust roller, and wherein said second slide member further includes a first shaft mounted rotatably thereon, said first shaft having a first part extending into said contact roller, and a second part extending outwardly of said contact roller, said first part being eccentric to said second part so as to place said contact roller in a position eccentric to said second part, said second slide member further including a push rod which has one end connected to said second part and which has an opposite end extending radially outward away from said first shaft, and a biasing unit mounted on said second slide member to bias said opposite end of said push rod so that said first shaft is turned in one direction and moves eccentrically said contact roller toward said cam member.

2. The reciprocating mechanism as claimed in claim 1, wherein said biasing unit includes a stationary support mounted on said second slide member, a cantilever arm which extends from said stationary support to said push rod and which passes through said opposite end of said push rod, and a coiled spring sleeved onto said cantilever arm to urge said push rod.

3. The reciprocating mechanism as claimed in claim 1, wherein said second slide member includes a bottom side adjacent to said first slide member, a top side opposite to said bottom side, and two through holes extending from said top side to said bottom side, said contact and thrust rollers being disposed adjacent to said bottom side, said first shaft extending through one of said through holes, said thrust roller having a second shaft extending through another one of said through holes, said biasing unit being disposed at said top side.

* * * * *